US009207566B2

(12) United States Patent
Sato

(10) Patent No.: US 9,207,566 B2
(45) Date of Patent: Dec. 8, 2015

(54) DEVELOPMENT DEVICE AND IMAGE FORMATION APPARATUS

(71) Applicant: Oki Data Corporation, Tokyo (JP)

(72) Inventor: Toshiharu Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/569,006

(22) Filed: Dec. 12, 2014

(65) Prior Publication Data

US 2015/0168866 A1 Jun. 18, 2015

(30) Foreign Application Priority Data

Dec. 16, 2013 (JP) ..... 2013-259310

(51) Int. Cl.
*G03G 15/08* (2006.01)

(52) U.S. Cl.
CPC ..... *G03G 15/0808* (2013.01); *G03G 15/0818* (2013.01)

(58) Field of Classification Search
CPC ..... G03G 15/0808; G03G 15/0818
See application file for complete search history.

(56) References Cited

U.S. PATENT DOCUMENTS 5,809,386 A * 9/1998 Iwata ..... 399/281
2014/0241760 A1* 8/2014 Shimomura ..... 399/281

FOREIGN PATENT DOCUMENTS

JP H10-039628 A 2/1998

* cited by examiner

*Primary Examiner* — Ryan Walsh
(74) *Attorney, Agent, or Firm* — Marvin A. Motsenbocker; Mots Law, PLLC

(57) ABSTRACT

A development device includes: a developer carrier configured to develop an electrostatic latent image with a developer while rotating, the electrostatic latent image being carried on a surface of a rotating electrostatic latent image carrier; and first and second developer supply members configured to, while rotating, supply the developer carrier with the developer contained in a developer container. The first developer supply member and the second developer supply member are disposed at positions opposed to the developer carrier, and in contact with the developer carrier. The first developer supply member is disposed downstream of the second developer supply member in a rotational direction of the developer carrier. A first contact amount at which the first developer supply member is in contact with the developer carrier is set smaller than a second contact amount at which the second developer supply member is in contact with the developer carrier.

14 Claims, 8 Drawing Sheets

FIG.5

| | CIRCUMFERENTIAL SPEED RATIO TO OPC (PHOTOCONDUCTIVE DRUM 21) | CIRCUMFERENTIAL SPEED RATIO TO DV (DEVELOPMENT ROLLER23) |
|---|---|---|
| PHOTO CONDUCTOR DRUM 21 | 1.000 | |
| DEVELOPMENT ROLLER 23 | 1.257 | 1.000 |
| SUPPLY ROLLER 251 ON DOWNSTREAM SIDE | 0.604 | 0.480 |
| SUPPLY ROLLER 251 ON UPSTREAM SIDE | 0.660 | 0.525 |

FIG. 6

| SAMPLE NUMBER | 1 | 2 | 3 | 4 | 5 | 6 | 7 | 8 | 9 |
|---|---|---|---|---|---|---|---|---|---|
| ABSOLUTE VALUE OF N1 [mm] | 0.05 | 0.12 | 0.20 | 0.31 | 0.46 | 0.69 | 1.07 | 1.87 | 3.51 |
| ABSOLUTE VALUE OF N2 [mm] | 0.46 | 0.46 | 0.46 | 0.46 | 0.46 | 0.46 | 0.46 | 0.46 | 0.46 |
| PROPORTION OF N1 | 10% | 20% | 30% | 40% | 50% | 60% | 70% | 80% | 88% |
| PROPORTION OF N2 | 90% | 80% | 70% | 60% | 50% | 40% | 30% | 20% | 12% |
| RESULT OF EVALUATION OF PRINT QUALITY | 1 | 1 | 3 | 3 | 2 | 1 | 1 | 1 | 1 |

FIG.7

IN THE CASE OF N2=0.50 MM

| SAMPLE NUMBER | 1 | 2 | 3 | 4 | 5 | 6 | 7 | 8 |
|---|---|---|---|---|---|---|---|---|
| ABSOLUTE VALUE OF N1 [mm] | 0.06 | 0.13 | 0.21 | 0.33 | 0.50 | 0.75 | 1.17 | 2.00 |
| ABSOLUTE VALUE OF N2 [mm] | 0.50 | 0.50 | 0.50 | 0.50 | 0.50 | 0.50 | 0.50 | 0.50 |
| PROPORTION OF N1 | 10% | 20% | 30% | 40% | 50% | 60% | 70% | 80% |
| PROPORTION OF N2 | 90% | 80% | 70% | 60% | 50% | 40% | 30% | 20% |
| RESULT OF EVALUATION OF PRINT QUALITY | 1 | 1 | 3 | 3 | 2 | 1 | 1 | 1 |

FIG.8

IN THE CASE OF N2=0.60 MM

| SAMPLE NUMBER | 1 | 2 | 3 | 4 | 5 | 6 | 7 | 8 |
|---|---|---|---|---|---|---|---|---|
| ABSOLUTE VALUE OF N1 [mm] | 0.07 | 0.15 | 0.26 | 0.40 | 0.60 | 0.90 | 1.40 | 2.40 |
| ABSOLUTE VALUE OF N2 [mm] | 0.60 | 0.60 | 0.60 | 0.60 | 0.60 | 0.60 | 0.60 | 0.60 |
| PROPORTION OF N1 | 10% | 20% | 30% | 40% | 50% | 60% | 70% | 80% |
| PROPORTION OF N2 | 90% | 80% | 70% | 60% | 50% | 40% | 30% | 20% |
| RESULT OF EVALUATION OF PRINT QUAITY | 1 | 1 | 3 | 3 | 2 | 1 | 1 | 1 |

DEVELOPMENT DEVICE AND IMAGE FORMATION APPARATUS

CROSS REFERENCE TO RELATED APPLICATIONS

This application claims priority based on 35 USC 119 from prior Japanese Patent Application No. 2013-259310 filed on Dec. 16, 2013, entitled "DEVELOPMENT DEVICE AND IMAGE FORMATION APPARATUS", the entire contents of which are incorporated herein by reference.

BACKGROUND OF THE INVENTION

1. Field of the Invention

This disclosure relates to a development device and an image formation apparatus, and is applicable, for example, to an electrophotographic printer.

2. Description of Related Art

Conventionally, in a development device used in an electrophotographic image formation apparatus (printer), an electric-charge roller as an electric-charge member electrically charges a photoconductor drum as an electrostatic latent image carrier; a light-emitting diode (LED) as an exposure member writes an electrostatic latent image onto the photoconductor drum; a development roller as a developer carrier develops the electrostatic latent image using a toner (developer); and a toner recovery member recovers toner remaining on the photoconductor drum after the transfer.

Furthermore, like an electrophotographic image formation apparatus disclosed in Japanese Patent Application Publication No. Hei 10-39628, a conventional electrophotographic image formation apparatus includes two supply rollers in the same shape as developer supply members. Along with including the two supply rollers, the image formation apparatus disclosed in Japanese Patent Application Publication No. Hei 10-39628 prevents the print density from varying between the preceding and succeeding halves of the print surface of a print sheet, and accordingly brings about effects such as the prevention of the formation of density steps in the print image.

SUMMARY OF THE INVENTION

In the conventional development device provided with the two supply rollers, the two supply rollers are pressed by the development roller and rotated in contact with the development roller. For this reason, the toner receives a large external force (stress). Since more external force than necessary is applied to the toner, a continuous print operation is more likely to cause print defects (for example, blurs in a toner image, smears and vertical streaks on a print sheet).

Furthermore, since the two supply rollers are pressed by the development roller and rotated in contact with the development roller, the conventional development device provided with the two supply rollers has a problem in that the rotational torque of the drive source (motor) of the development roller is so large that the drive source of the development roller and the like tend to wear easily.

An object of an embodiment of the invention is to provide a configuration in which a developer carrier rotates in contact with two developer supply members with a life longer than a predetermined length, and concurrently to suppress any deterioration in the quality of the image formation.

A first aspect of the invention is a development device that includes: (1) a developer carrier configured to develop an electrostatic latent image with a developer while rotating, the electrostatic latent image being carried on a surface of a rotating electrostatic latent image carrier; and (2) first and second developer supply members configured to, while rotating, supply the developer carrier with the developer contained in a developer container. The development device is further characterized in that: (3) the first developer supply member and the second developer supply member are disposed at positions opposed to the developer carrier, and in contact with the developer carrier; (4) the first developer supply member is disposed downstream of the second developer supply member in a rotational direction of the developer carrier; and (5) a first contact amount at which the first developer supply member is in contact with the developer carrier is set smaller than a second contact amount at which the second developer supply member is in contact with the developer carrier.

The aspect of the invention can provide a life longer than a predetermined length, and concurrently suppress deterioration in the quality of the image formation.

BRIEF DESCRIPTION OF THE DRAWINGS

FIG. 5 is an explanatory diagram illustrating circumferential speed ratios among a photoconductor drum, the development roller and the supply rollers which are included in the development device of the embodiment.

FIG. 6 is an explanatory diagram illustrating a result of an experiment (Part 1 where N2=0.46 mm) using the development device of the embodiment.

FIG. 7 is an explanatory diagram illustrating a result of an experiment (Part 2 where N2=0.50 mm) using the development device of the embodiment.

FIG. 8 is an explanatory diagram illustrating a result of an experiment (Part 3 where N2=0.60 mm) using the development device of the embodiment.

DETAILED DESCRIPTION OF EMBODIMENTS

Figure 1:
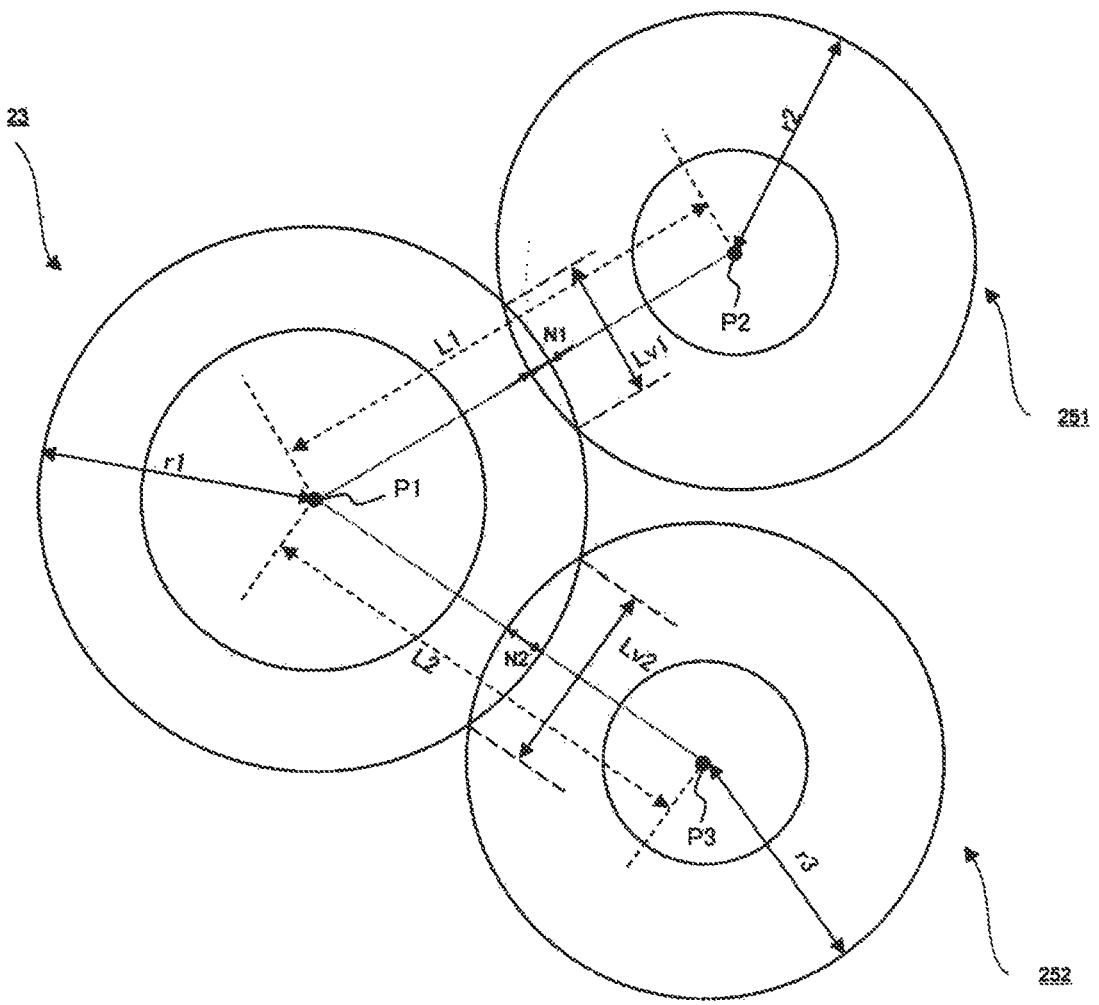
FIG. 1 is an explanatory diagram illustrating a relationship among a development roller and supply rollers in an embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

(A) Principal Embodiment

Referring to the drawings, detailed descriptions are provided for a development device and an image formation apparatus according to an embodiment of the invention. The embodiment describes an example where the development device and the image formation apparatus of the invention are applied to a printer.

(A-1) Configuration of Embodiment

Figure 2:
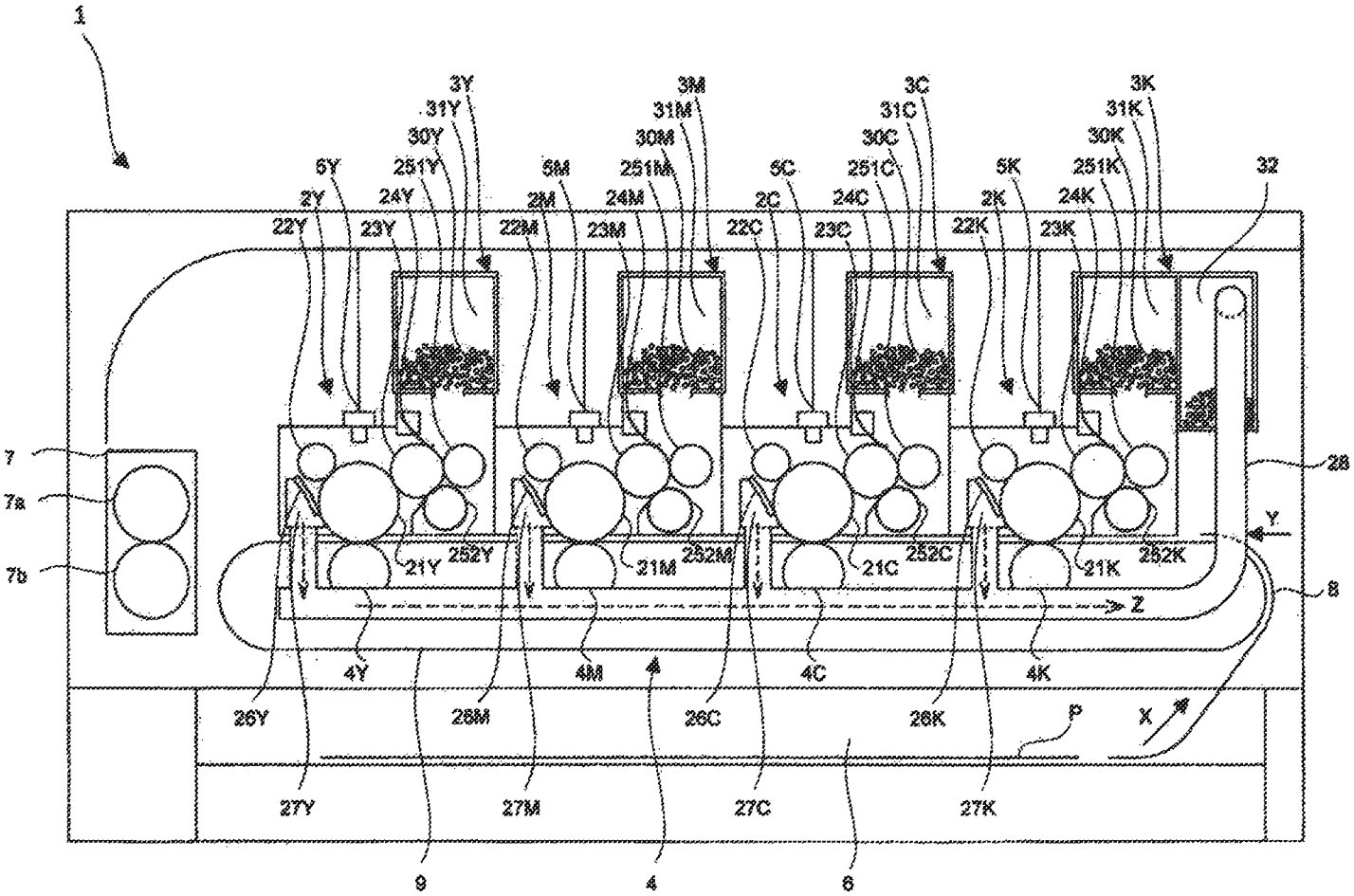
FIG. 2 is an explanatory diagram illustrating a schematic cross-sectional view of an image formation of the embodiment.

FIG. 2 is a schematic cross-sectional view illustrating an overall configuration of image formation apparatus (printer) 1 of the embodiment.

Printer 1 includes: development devices 2 (2K, 2C, 2M, 2Y) corresponding to black (K), cyan (C), magenta (M) and yellow (Y) developers (toners) 30 (30K, 30C, 30M, 30Y); and toner cartridges 3 (3K, 3C, 3M, 3Y) as developer containers configured to contain toners 30 (30K, 30C, 30M, 30Y).

Printer 1 further includes: transfer units 4 (4K, 4C, 4M, 4Y) configured to transfer toner images, developed respectively by photoconductor drums 21 (21K, 21C, 21M, 21Y) as electrostatic latent image carries which are described later, onto sheet P; and exposure units 5 (5K, 5C, 5M, 5Y) configured to form electrostatic latent images on the surfaces of photoconductor drums 21 by casting light on the surfaces of photoconductor drums 21, respectively.

Printer 1 further includes: sheet feeder cassette 6 configured to contain sheets (media) P, and to feed sheets P in an X direction in FIG. 2; fixation unit 7 configured to fix the toner images which are transferred onto sheet P by transfer units 4; and sheet conveyance path 8 shaped almost like the letter S in printer 1 (shaped almost like the letter S when viewed in a direction from FIG. 2).

Development devices 2K, 2C, 2M, 2Y are sequentially disposed along sheet conveyance path 8 in a direction (a Y direction in FIG. 2) from an upstream side (a sheet feeder side) to a downstream side (a delivery side) of the conveyance of sheets P. In addition, development devices 2K, 2C, 2M, 2Y are detachably disposed in the main body (chassis) of printer 1. The basic configuration is common among development devices 2K, 2C, 2M, 2Y, while only the toner color is different among development devices 2K, 2C, 2M, 2Y, which respectively use toners 30K, 30C, 30M, 30Y for their development. Using FIG. 3, descriptions are hereinbelow provided for a detailed configuration of one of development devices 2.

Development device 2 includes: electric-charge roller 22, as an electric-charge member, configured to electrically charge photoconductor drum 21 and its surface evenly; and development roller 23, as a developer carrier, configured to develop toner 30 on photoconductor drum 21.

Development device 2 further includes: development blade 24 configured to control a layer thickness of toner 30 supplied onto the development roller 23; and two supply rollers 251, 252, as developer supply members, configured to supply toner 30 to development roller 23.

Development device 2 further includes: cleaning blade 26 configured to remove residual toner 30 which is not transferred to sheet P and remains on photoconductor drum 21; and conveyer 27 configured to convey residual toner 30, which is removed by cleaning blade 26, as waste toner 30.

In the embodiment, photoconductor drum 21 is an organic photoconductor formed from a conductive support body and a photoconductive layer, for example. The organic photoconductor is formed by sequentially stacking a blocking layer, an electric-charge generation layer as the photoconductive layer, and an electric charge transport layer on a metal pipe, as the conductive support body, made from aluminum or the like.

In the embodiment, electric-charge roller 22 is formed from a metal shaft and a semiconductive rubber layer made from epichlorohydrin rubber or the like, for example. In addition, electric-charge roller 22 is in contact with photoconductor drum 21 at a predetermined contact amount (pressure contact amount), and is rotated in conjunction with the rotation of photoconductor drum 21.

In the embodiment, for example, development roller 23 has a configuration in which semiconductive rubber layer (semiconductive urethane rubber layer) 23*b* as a semiconductive elastic layer is formed on the surface of shaft (metal shaft) 23*a* as a core bar. Development roller 23 is in contact with photoconductor drum 21 at a predetermined contact amount (pressure contact amount), and rotates in a rotational direction following the rotation of photoconductor drum 21 (a Z1 direction in FIG. 3) at a predetermined ratio of the circumferential speed of development roller 23 to the circumferential speed of photoconductor drum 21.

In the embodiment, development blade 24 is 0.08 [mm] in thickness, and is almost as long as the length of development roller 23 in its longitudinal direction, for example. Development blade 24 is formed from a metal thin-plate member configured to control the layer thickness of toner 30. Development blade 24 is disposed with its one end in its longitudinal direction fixed to a frame (not illustrated) (the chassis of the main body of printer 1) , and with a surface portion slightly inner from its tip end portion on its opposite end side, with the surface portion being in contact with development roller 23.

In the embodiment, supply rollers 251, 252 are respectively formed by forming conductive foam layers (for example, semiconductive foam silicone sponge layers) 251*b*, 252*b* on the surfaces of shafts (for example, metal shafts) 251*a*, 252*a* as core bars, for example. Supply rollers 251, 252 are in contact with development roller 23 at a predetermined contact amount (pressure contact amount), and rotate in directions (Z2, Z3 directions in FIG. 3) counter to the rotational direction (the Z1 direction in FIG. 3) of development roller 23 at predetermined ratios of the circumferential speeds of supply rollers 251, 252 to the circumferential speed of development roller 23.

Cleaning blade 26 is disposed at a position which puts one end of cleaning blade 26 in contact with photoconductor drum 21 at a predetermined contact amount (pressure contact amount), and is formed from a urethane rubber.

Conveyer 27 conveys residual toner 30 and attached matter, which are removed by cleaning blade 26 as waste toner 30, toward the foreground in the rotational direction of the photoconductor drum 21. Toner 30 conveyed by conveyer 27 passes through a conveyance path (not illustrated) for waste toner 30, and is collected by a waste toner collection unit (not illustrated).

Toner supply port 253 is an orifice (an opening hole) through which to supply toner 30 from toner cartridge 3 to a toner container inside development device 2.

Toner agitation mechanism 254 is a rotary member shaped like a spiral in its longitudinal direction.

Toner receiver 255 receives part of toner 30 supplied through toner supply port 253.

It should be noted that development device 2 and toner cartridge 3, which are described above, are replaceable components (replaceable units) for printer 1. For this reason, development device 2 and toner cartridge 3 can be replaced at times, for example, when toner 30 contained there is consumed, and when constituent parts deteriorate.

Transfer unit 4 is provided with: transfer belt 9, a drive roller (not illustrated) and a tension roller (not illustrated) which are opposed to and in pressure contact with photoconductor drums 21K, 21C, 21M, 21Y. Transfer belt 9 electrostatically adsorbs and thereby conveys sheet P. The drive roller is rotated by a driver (not illustrated), and thus drives transfer belt 9. The tension roller is paired with the drive roller, and transfer belt 9 is suspended between the drive roller and the tension roller. Furthermore, transfer unit 4 includes transfer rollers 4K, 4C, 4M, 4Y configured to transfer their respective toner images onto sheet P.

Each of exposure units 5K, 5C, 5M, 5Y is a LED (Light Emitting Diode) head which includes: a light emitting element such as an LED; and a lens array.

Sheet feeder cassette 6 contains sheets P in its inside with sheets P stacked one on another, and is detachably attached to the lower portion of printer 1. A sheet feeder (not illustrated), which includes a hopping roller and the like configured to separate and send sheets P on a one-by-one basis, is provided to an upper portion of sheet feeder cassette 6.

Fixation unit 7 is disposed on the downstream side of sheet conveyance path 8 (on the downstream side in the direction of the sheet conveyance), and includes heat roller 7*a* and pressure roller 7*b* as well as a thermistor and a heater (which are not illustrated). Heat roller 7*a* is formed, for example, by: covering a core bar, made from aluminum or the like and shaped like a hollow cylinder, with a heat-resistant elastic layer made from silicone rubber; and covering the heat-resistant elastic layer with a PFA (tetrafluoroethylene-perfluoroalkylvinylether copolymer) tube. Furthermore, the heater such as a halogen lamp is provided inside the core bar, for example. Pressure roller 7*b* is formed, for example, by: covering a core bar, made from aluminum or the like, with a heat-resistant elastic layer made from silicone rubber; and covering the heat-resistant elastic layer with a PFA tube. Pressure roller 7*b* is disposed to bring a portion thereof into pressure contact with heat roller 7*a*. The thermistor is a surface temperature detector configured to detect the surface temperature of heat roller 7*a*, and is disposed near and out of contact with heat roller 7*a*.

Using FIG. 4, descriptions are hereinbelow provided for a detailed configuration of supply rollers 251, 252.

Figure 4:
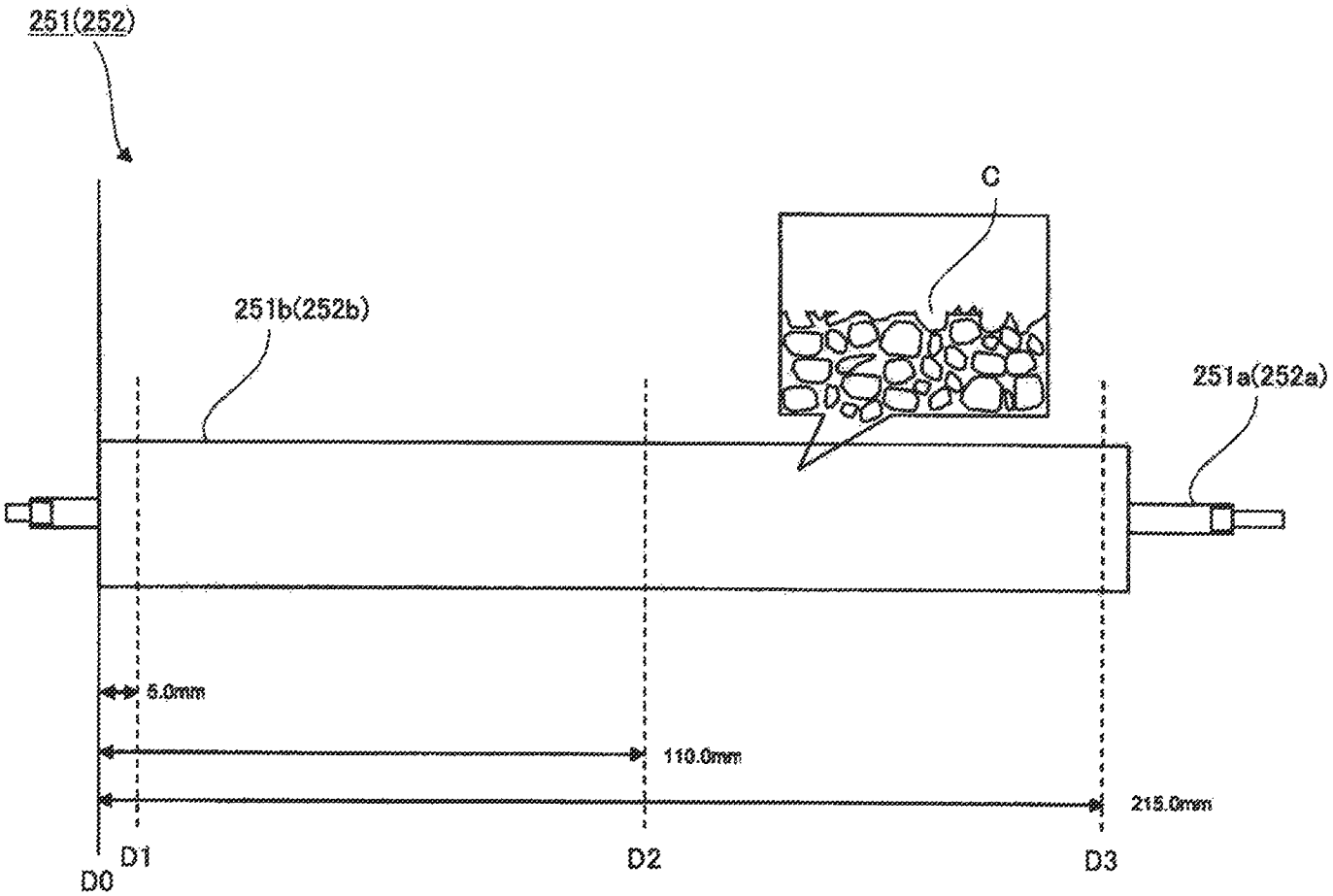
FIG. 4 is a plan view of one of the supply rollers in the embodiment.

FIG. 4 is a plan view of supply rollers 251, 252.

The embodiment is described citing a case where supply rollers 251, 252 have the same shape and the same structure, for example.

In supply rollers 251, 252 of the embodiment, conductive foam layers 251*b*, 252*b* are formed around shafts 251*a*, 252*a*. Conductive foam layers 251*b*, 252*b* each have countless cells C.

Examples of the material to be used for conductive foam layers 251*b*, 252*b* include: rubber materials such as silicone rubber, silicone-modified rubber, natural rubber, nitrile rubber, ethylene propylene rubber (EPM), ethylene propylene diene rubber (EPDM), styrene-butadiene rubber, acrylonitrile butadiene rubber, butadiene rubber, isoprene rubber, acrylic rubber, chloroprene rubber, butyl rubber, epichlorohydrin rubber, urethane rubber, fluororubber, and polyether rubber; and elastomers such as polyurethane, polystyrene, polybutadiene block polymer, polyolefin, polyethylene, chlorinated polyethylene, and an ethylene-vinyl acetate polymer. One or more of these mixed and modified rubber materials may be used for conductive foam layers 251*b*, 252*b*. Furthermore, the material of conductive foam layers 251*b*, 252*b* maybe arbitrarily chosen from materials of a millable-type and a liquid-type. The millable-type material is particularly desirable.

Shafts 251*a*, 252*a* may be made from a metal having a predetermined rigidity and a sufficient electrical-conductivity. For example, iron, copper, brass, stainless steel, aluminum, nickel or the like can be used as the material of shafts 251*a*, 252*a*. Instead, even a non-metal material may be used as the material thereof as long as the material has the sufficient electrical-conductivity and the predetermined rigidity. Otherwise, a resin molded product, ceramics or the like containing dispersed conductive particles may be used as the material thereof . Shafts 251*a*, 252*a* is not only shaped like a roll, but also may be shaped like a hollow pipe. Furthermore, a gear attachment step and a pinhole may be formed in the two ends of each of shafts 251*a*, 252*a*. Moreover, the outer diameters of shafts 251*a*, 252*a* are smaller in their two end portions than in portions where conductive foam layers 251*b*, 252*b* are formed, because portions (tip end shaft reception portions) linking to a normal drive source (a motor) are formed in the two ends of each of shafts 251*a*, 252*a*. A method of manufacturing supply rollers 251, 252, for example, may be one in which: a reinforcement filler and an electrical-conductivity imparting agent, as well as curing and foaming agents which are needed for curing and hardening, are added to the above-mentioned rubber materials; the mixture of the rubber materials, the filler and the agents are sufficiently kneaded with a pressurized kneader, a mixing roll or the like; thereafter, the uncured rubber compound is extruded, etc., onto shafts 251*a*, 252*a* to form precursors to supply rollers 251, 252; and performing curing and foaming on the precursors by heating. Otherwise, supply rollers 251, 252 may be formed by covering shafts 251*a*, 252*a* with sponge rubber tubes, each of which is beforehand molded by: extruding the rubber compound into the shape of a tube: and performing curing and forming on the tube-shaped rubber compound by heating. In this case, shafts 251*a*, 252*a* and conductive foam layers 251*b*, 252*b* may be fixed to each other with an adhesive depending on the necessity. Thereafter, thus-molded supply rollers 251, 252 need to be machined until each of supply rollers 251, 252 comes to have the predetermined outer diameter.

In the embodiment, the width of semiconductive rubber layer 23*b* is set at 220.00 mm. In FIG. 4, D0 denotes the left end of semiconductive rubber layer 23*b* in its widthwise direction; D1 denotes a position 5.00 mm away from the left end thereof; D2 denotes a position 110.00 mm away from the left end thereof (a position in the middle of semiconductive rubber layer 23*b* in its widthwise direction); and D3 denotes a position 215.00 mm away from the left end thereof (a position 5.00 mm away from the right end thereof). Hereinbelow, ϕD1, ϕD2, ϕD3 denote the outer diameters of supply rollers 251, 252 (the outer diameters of conductive foam layers 251*b*, 252*b*) at positions D1, D2, D3.

Generally, supply rollers 251, 252 are formed in a straight shape in a way that outer diameters ϕD1, ϕD2, ϕD3 are equal to one another. Instead, however, supply rollers 251, 252 may be formed in such a crown shape or a tapered shape that outer diameter ϕD2 is the largest. Otherwise, supply rollers 251, 252 may be formed in such a shape that outer diameter ϕD2 is the smallest.

Figure 3:
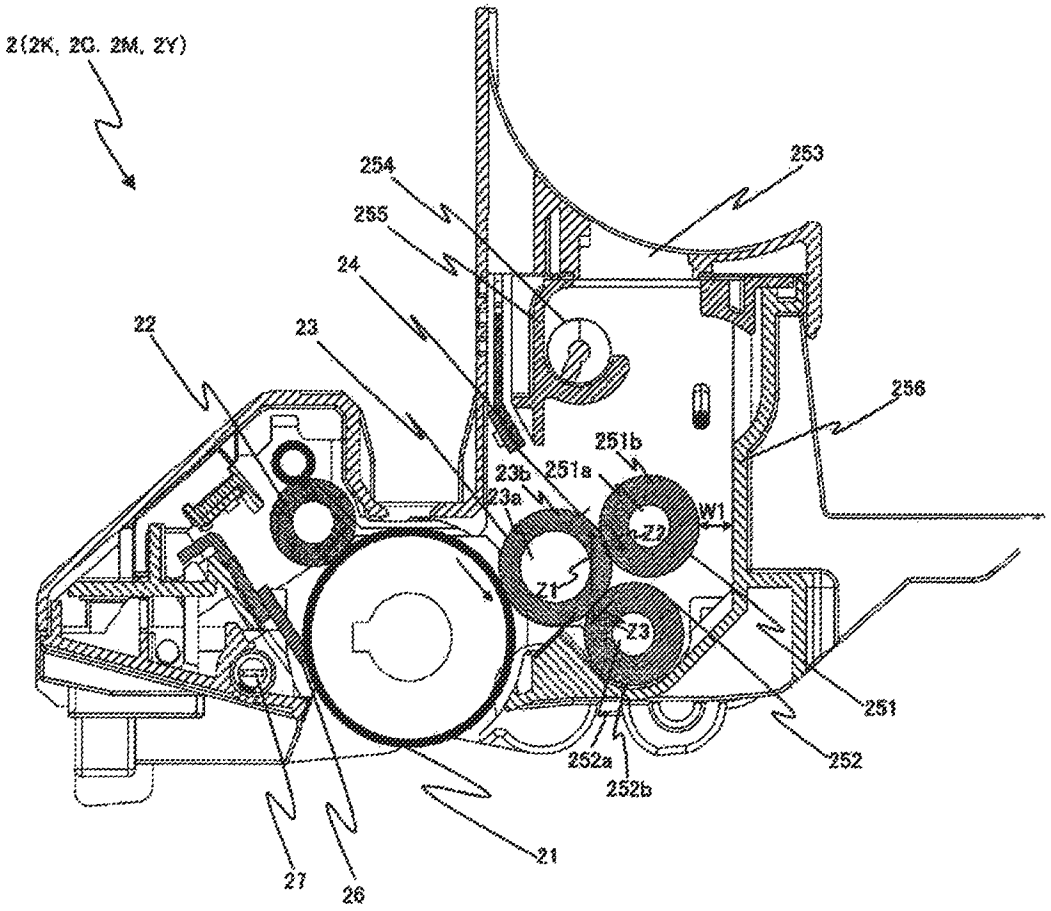
FIG. 3 is a cross-sectional view of a development device of the embodiment.

Furthermore, in FIG. 3 illustrating development device 2, w1 denotes a distance (the shortest distance) from the outer peripheral surface of supply roller 251 to the inner wall surface of housing 256 of development device 2.

Next, descriptions are provided for a contact amount (hereinafter referred to as a "NIP" amount) between development roller 23 and each of supply rollers 251, 252.

FIG. 1 is an explanatory diagram illustrating a relationship among development roller 23 and the two supply rollers 251, 252.

The NIP amount measures how much development roller 23 and each of supply rollers 251, 252, which are illustrated in FIG. 1, are in contact with and pressed against each other. In FIG. 1, P1, P2, P3 denote the central positions of the rotational shafts of development roller 23, supply roller 251 and supply roller 252. Furthermore, in FIG. 1, r1, r2, r3 denote the radii of development roller 23, supply roller 251 and supply roller 252 (the widths from the central positions of the rotational shafts to the outer peripheral surface of semiconductive rubber layer 23*b*). Furthermore, in FIG. 1, L1 denotes the width between central positions P1, P2 of development roller 23 and supply roller 251 in a state of being in contact with and pressed against each other, and L2 denotes the width between central positions P1, P3 of development roller 23 and supply roller 252 in a state of being in contact with and pressed against each other. Moreover, in FIG. 1, N1 denotes a NIP amount between development roller 23 and supply roller 251, and N2 denotes a NIP amount between development roller 23 and supply roller 252. In this respect, NIP amounts N1, N2 are expressed with Expressions (1), (2) given below, respectively.

$$N1=r1+r2-L1 \quad \text{Expression (1)}$$

$$N2=r1+r3-L2 \quad \text{Expression (2)}$$

Hereinbelow, N1 denotes the NIP amount of supply roller 251 located downstream of the rotation of development roller 23 (the rotation in a Z1 direction), and N2 denotes the NIP amount of supply roller 252 located upstream of the rotation of development roller 23 (the rotation in a Z1 direction).

Furthermore, in FIG. 1, Lv1 denotes the width (hereinafter referred to as "the NIP width") from the start to end positions of the contact between supply roller 251 and development roller 23, and Lv2 denotes the NIP width from the start to end positions of the contact between supply roller 252 and development roller 23.

Both supply roller 251 on the upstream side and supply roller 252 on the downstream side rotate while in contact with toner 30 from toner cartridge 3, and development roller 23. Accordingly, while supply rollers 251, 252 scrap toner 30 at their portions in contact with development roller 23, supply rollers 251, 252 supply toner 30 to development roller 23 by electrically charging toner 30 through their friction with development roller 23. Incidentally, supply roller 251 on the downstream side in development device 2 principally performs a function of supplying toner 30 to development roller 23. On the other hand, supply roller 252 on the upstream side principally performs a function of scraping toner 30 which remains on development roller 23 after the development.

For this reason, if NIP amount N1 of supply roller 251 on the downstream is too small, the amount of toner 30 to be supplied to development roller 23 runs short, which causes burrs in the printing (blurred printing due to the shortage of the supply of toner 30). On the other hand, if NIP amount N1 of supply roller 251 on the downstream is too large, stress in excess (an excessive amount of electric charges in toner 30, and the like due to stress in excess) causes smears in the printing (smears due to the excessive supply of toner 30).

In addition, if NIP amount N2 of supply roller 252 on the upstream is too small, toner 30 is insufficiently scraped from development roller 23, which causes ghost and density steps (variations in density from one region to another) in the printing. On the other hand, if NIP amount N2 of supply roller 252 on the upstream is too large, stress in excess (an excessive amount of electric charges in toner 30, and the like due to stress in excess) causes smears in the printing.

Moreover, if NIP amounts N1, N2 are too large, frictions between development roller 23 and supply rollers 251, 252, as well as the load imposed on the drive sources for the rollers, become larger, which makes the life of development device 2 as a whole shorter than its intended life (expected by the specification). On the other hand, if NIP amounts N1, N2 are too small, supply rollers 251, 252 and development roller 23 come out of contact with each other after slightly wearing, which similarly makes the life of development device 2 as a whole shorter than its intended life (expected by the specification).

As described above, the principal function is different between supply roller 251 on the downstream and supply roller 252 on the upstream because of their positional relationships. For this reason, NIP amounts N1, N2 in development device 2 need not be at an equal value, and it is desirable that NIP amounts N1, N2 be set depending on: the principal functions of the supply rollers based on their positional relationships; and the balance between the supply rollers in accordance with how much the supply rollers frictionally wear.

As described above, supply roller 251 on the downstream side and supply roller 252 on the upstream side scrape toner 30 from the regions of development roller 23 twice, and supply toner 30 to the regions of development roller 23 twice. For this reason, discrepancies (insufficient scrape and excessive supply of toner 30) occurring in supply roller 252 on the upstream side can be corrected by supply roller 251 on the downstream side to a certain extent. Furthermore, if NIP amount N1 of supply roller 251 on the downstream side is too large, the abrasion of supply roller 251 against development roller 23 produces an abrasion powder, which resultantly stays on and around development blade 24 on the further downstream side and causes vertical smear streaks and the like in print images. In contrast, even when the abrasion of supply roller 252 on the upstream side similarly produces an abrasion powder, the abrasion powder hardly reaches development blade 24 because the abrasion powder is blocked by supply roller 251 on the downstream side. For these reasons, when NIP amount N2 of supply roller 252 on the upstream side is set larger than NIP amount N1 of supply roller 251 on the downstream side, a better print quality can be maintained.

Furthermore, conditions (the amount of residual toner 30 and the amount of electric charges) of the regions of supply roller 251 on the downstream side and development roller 23 which are in contact with each other vary depending on NIP amount N2 of supply roller 252 on the upstream. For this reason, in development device 2, NIP amount N1 of supply roller 251 on the downstream side needs to be set in accordance with its balance with NIP amount N2 of supply roller 252 on the upstream side.

As described above, in development device 2, NIP amounts of two supply rollers 251, 252 need to be set with such a range and balance that development device 2 can survive its intended life and produce better print quality. The following explanatory section concerning the workings concretely describes how to set the two NIP amounts N1, N2.

(A-2) Workings of Embodiment

Descriptions are provided for how printer 1 of the embodiment including the above-described configuration works.

To begin with, descriptions are provided for how printer 1 works as a whole using FIG. 1.

Upon receipt of print data, printer 1 drives development devices 2K, 2C, 2M, 2Y, and replenishes toners 30K, 30C, 30M, 30Y from toner cartridges 3K, 3C, 3M, 3Y. Upon receipt of the print data, printer 1 feeds sheet P from the inside of sheet feeder cassette 6, and conveys sheet P along sheet conveyance path 8. While conveyed sheet P sequentially passes under development devices 2K, 2C, 2M, 2Y, transfer units 4 transfer toner images formed on photoconductor drums 21*k*, 21C, 21M, 21Y through the exposure by LED heads 5K, 5C, 5M, 5Y onto sheet P. Fixation unit 7 fixes the toner images onto sheet P. Thereafter, printer 1 delivers sheet P to the outside of printer 1.

The basic workings are the same among development devices 2K, 2C, 2M, 2Y. For this reason, the following descriptions are provided for one development device 2.

After electric-charge roller 22 electrically charges the surface of photoconductor drum 21 equally and evenly, photoconductor drum 21 forms an electrostatic latent image using light emitted from exposure unit 5.

An electric-charge roller power supply (not illustrated) configured to apply a bias voltage which is the same in polarity as toner 30 is connected to electric-charge roller 22. Using the bias voltage applied by the electric-charge roller power supply, electric-charge roller 22 electrically charges the surface of photoconductor drum 21 equally and evenly.

A development roller power supply (not illustrated) configured to apply a bias voltage whose polarity is the same as or opposite to that of toner 30, is connected to development roller 23. Using the bias voltage applied by the development roller power supply, development roller 23 makes electrically-charged toner 30 adhere to an electrostatic latent image portion on photoconductor drum 21.

The e roller power supply (not illustrated) or a supply roller power supply (not illustrated) configured to apply a bias voltage whose polarity is the same as or opposite to that of toner 30 is connected to development blade 24. Using the applied bias voltage and the pressure at which development blade 24 is in contact with development roller 23, development blade 24 controls the electric-charges and the layer of toner 30 on development roller 23.

The supply roller power supply (not illustrated) configured to apply a bias voltage which is the same in polarity as toner 30, or a bias voltage with the polarity opposite to that of toner 30, is connected to supply rollers 251, 252. Using the bias voltage applied by the supply roller power supply, supply rollers 251, 252 supply development roller 23 with toner 30 which is replenished from supply toner container 31 included in toner cartridge 3. Furthermore, using a force produced by the friction between supply rollers 251, 252 and development roller 23, supply rollers 251, 252 electrically charge toner 30, and scrape undeveloped toner on development roller 23.

Cleaning blade 26 cleans the surface of photoconductor drum 21 by scraping toner 30 which remains on the surface of photoconductor drum 21. Furthermore, cleaning blade 26 also scrapes attached matter which, albeit small in amount, adherers to photoconductor drum 21 from transfer belt 9.

Conveyer 27 conveys residual toner 30 and the attached matter, which are removed by cleaning blade 26, as waste toner 30, toward the foreground in the rotational direction of the photoconductor drum 21. Toner 30 conveyed by conveyer 27 passes through the conveyance path (not illustrated) for waste toner 30 inside development device 2, and is conveyed to the waste toner collection unit.

Toner supply port 253 is a connection port configured to supply toner 30, fed from toner cartridge 3, to the inside of development device 2, and is open with a predetermined dimension.

Toner agitation mechanism 254 agitates toner 30, received by toner receiver 255, toward the two ends in the axial direction.

In order for toner agitation mechanism 254 to agitate toner 30, toner receiver 255 receives part of toner 30 supplied from toner supply port 253.

In toner cartridges 3K, 3C, 3M, 3Y, supply toner containers 31K, 31C, 31M, 31Y have agitation supply mechanisms (not illustrated) in their insides, respectively. The agitation supply mechanisms replenish development devices 2K, 2C, 2M, 2Y with unused toners 30K, 30C, 30M, 30Y, respectively.

Transfer roller power supplies (not illustrated) configured to apply bias voltages with the polarity opposite to those of toners 30K, 30C, 30M, 30Y are connected to transfer rollers 4K, 4C, 4M, 4Y in transfer units 4, respectively. Using the bias voltages applied by the transfer roller power supplies, respectively, transfer rollers 4K, 4C, 4M, 4Y transfer toner images, formed on photoconductor drums 21K, 21C, 21M, 21Y, to sheet P.

On the basis of received print data, LED heads 5K, 5C, 5M, 5Y irradiate the surfaces of photoconductor drums 21K, 21C, 21M, 21Y with their light, and thereby form the electrostatic latent images by optically attenuating electric potentials in the light irradiated portions.

Conveyance rollers (not illustrated) convey sheet P, supplied into sheet feeder cassette 6, to under development devices 2.

Fixation unit 7 controls the heater on the basis of the surface temperature of heater roller 7*a* detected by the thermistor, and thereby keeps the surface temperature of heater roller 7*a* at a predetermined temperature. When sheet P onto which the toner images are transferred passes through a pressure contact section formed from pressure roller 7*b* and heater roller 7*a* kept at the predetermined temperature, heat and pressure are given to sheet P. Thereby, the toner images on sheet P are fixed to sheet P.

Next, concrete examples of how each development device 2 works are described using the results of an experiment (hereinafter referred to as a "main experiment") with development device 2. The main experiment is mainly intended to find suitable combinations of values representing NIP amounts N1, N2 . Although the following descriptions discuss various conditions for the main experiment, the conditions are just examples from which satisfactory results are obtained in realizing the development device of the invention (which bring about characteristic effects), and impose no restriction on the configuration of the development device of the invention.

The main experiment uses foam layers, based on a silicone rubber compound, for conductive foam layers 251*b*, 252*b* of supply rollers 251, 252. Cells C in conductive foam layers 251*b*, 252*b* are discrete foams independent of one another. In general, the preferable hardness of the conductive foam layers for forming supply rollers 251, 252 measured by an Asker F type durometer is in a range of 45 degrees to 65 degrees. The main experiment uses the conductive foam layers whose hardness is at 58 degrees. In general, the preferable size of cells C included in conductive foam layers 251*b*, 252*b* is in a range of 100 μm to 1000 μm. The main experiment uses the conductive foam layers 251*b*, 252*b* including cells C whose size is in a range of 200 μm to 400 μm in the surfaces of conductive foam layers 251*b*, 252*b*. Furthermore, it is preferable to adjust the resistance values of supply rollers 251, 252 in a range of 0.1 MΩ to 100 MΩ when supply rollers 251, 252 are supplied with 300 V from shafts 251*a*, 252*a* while being rotated in contact at a 20 gf force with a SUS-material ball bearing, 2.0 mm in width and 6.0 mm in diameter. The main experiment sets the resistance value at 1 MΩ.

Furthermore, in the main experiment, as illustrated in FIG. 4 described above, the overall widths of conductive foam layers 251*b*, 252*b* are 220 mm. The main experiment uses conductive foam layers 251*b*, 252*b* having a straight shape which makes the outer diameters of conductive foam layers 251*b*, 252*b* equal to 14.0 mm at any position. Incidentally, before the main experiment, it is made sure that the outer diameters of conductive foam layers 251*b*, 252*b* (the outer diameters of supply rollers 251, 252) are 14.0 mm at any of positions D1, D2, D3 away from reference position D0 (that is to say, the positions respectively 5.0 mm, 110.0 mm and 215.0 mm away from reference position D0) by measuring the diameters thereof at positions D1, D2, D3 as illustrated in FIG. 4. In addition, the main experiment uses development roller 23 whose radius r1 is 8.00 mm.

In addition, the main experiment sets ratios among the circumferential speeds of photoconductor drum 21, development roller 23 and supply rollers 251, 252 as illustrated in FIG. 5. As illustrated in FIG. 5, with respect to the circumferential speed of photoconductor drum 21 as a reference (1.000), the circumferential speed ratio of development roller 23 is 1.257, the circumferential speed ratio of supply roller 251 on the downstream side is 0.604, and the circumferential speed ratio of supply roller 252 on the upstream side is 0.660 in the main experiment. Moreover, with respect to the circumferential speed of development roller 23 as a reference (1.000), the circumferential speed ratio of supply roller 251 on the downstream side is 0.480, and the circumferential speed of supply roller 252 on the upstream side is 0.525 in the main experiment.

Moreover, it is desirable that NIP amounts N1, N2 in development device 2 used in the main experiment be set in a range of 0.1 mm to 2.0 mm. It is more desirable that NIP amounts N1, N2 be set at 0.2 mm or more in order to suppress defects in a print image which are caused by an insufficient scraping of toner 30 (for examples, blurs, ghosts, density steps and smears). Furthermore, it is more desirable that NIP amounts N1, N2 be set at 1.00 mm or less in order to suppress defects in a print image which are caused by a supply of toner 30 in excess (for example, smears), and defects in a print image which are caused by excessive load (torque) imposed on the drive sources for the rollers (for example, jitters attributed to the wear and abrasion of the rotational shafts, and the occurrence of streaks attributed to pieces worn off of the rollers). Judging from these factors, it is much more desirable that NIP amounts N1, N2 be set in a range of 0.20 mm to 1.00 mm.

In addition, w1 illustrated in FIG. 3 is set at 5.00 mm in development device 2 used in the main experiment.

Furthermore, for the main experiment, NIP amounts N1, N2 are set in combinations as illustrated in FIG. 6. Thereafter, for each of the NIP amount combinations, printer 1 performs a continuous endurance printing (performs printing on sheets P continuously until the life of the apparatus stated in the specification expires), and the print quality is evaluated.

For each sample (representing a combination of NIP amounts N1, N2 ), FIG. 6 illustrates the absolute values of NIP amounts N1, N2, proportions (in percentage terms) of NIP amounts N1, N2 relative to each other, and a result of evaluating the print quality.

As illustrated in FIG. 6, the main experiment keeps NIP amount N2 fixed at 0.46 mm for all the samples, and changes NIP amount N1 (in a range of 0.05 mm to 3.51 mm) in the order of Samples 1 to 9. To put it concretely, NIP amounts N1 for Samples 1 to 9 are 0.05 mm, 0.12 mm, 0.20 mm, 0.31 mm, 0.46 mm, 0.69 mm, 1.07 mm, 1.84 mm and 3.51 mm, respectively.

Note that it is desirable that NIP widths Lv1, Lv2 of supply rollers 251, 252 in development device 2 used in the main experiment be in a range of approximately 1.70 mm to 7.5 mm. In development device 2 used in the main experiment, NIP width Lv1 is 3.67 mm when NIP amount N1 of supply roller 252 on the upstream side is set at 0.46 mm.

The proportions of NIP amounts N1, N2 illustrated in FIG. 6 are in percentage terms. In each sample, the sum of the two proportional values is equal to 100% (N1 +N2=100%) . For example, in Sample 1 in FIG. 6, since N1=0.05 mm and N2=0.46 mm, the proportions of NIP amounts N1, N2 are approximately 10% and 90%, respectively. In this context, NIP amount N1 increases by approximately 10 each from 10% to 20%, 30%, 40%, 50%, 60%, 70%, 80% and 90% in the order of Samples 1 to 9. In contrast, the NIP amount N2 decreases by approximately 10% each from 90% to 80%, 70%, 60%, 50%, 40%, 30%, 20% and 10%.

The main experiment carries out the continuous endurance printing for the purpose of realizing development device 2 whose life satisfies a 72000 drum count specification for the printer. Incidentally, the drum count is defined as increasing by one each time photoconductor drum 21 turns. The main experiment uses print sheets, known as "Xerox (trademark) 4200 multipurpose copy paper, letter size, 20 lbs, new 92 brightness" made by Xerox Corporation, as sheets P (media for the evaluation). Furthermore, for each NIP amount combination, the main experiment causes a printer (a printer to which development device 2 is applied) to perform intermittent printing with a pattern printed in 1.25% of printable area on each sheet P, until the drum count reaches 72000. Thereafter, the main experiment evaluates the results of the printing which the printer performs until the 72000 drum count is reached (the life of photoconductor drum 21). Samples (each representing a combination of NIP amounts N1, N2) which are evaluated as causing no problem with the print quality are rated at Grade "1"; samples which are evaluated as causing minor problems with the print quality are rated at Grade "2"; and samples which are evaluated as causing major problems with the print quality are rated at Grade "3."

It should be noted that as described above, development device 2 needs NIP amounts N1, N2 to be adjusted in order for development device 2 to endure for its overall device life or longer. Meanwhile, NIP amount N1 suitable for the downstream side differs depending on NIP amount N2 to be set for the upstream side. With this taken into consideration, the main experiment adopts a method in which: at time of the start of the experiment (while supply roller 252 on the upstream side is still in an unused condition), the least required NIP amount N2 is fixedly set in order for supply roller 252 on the upstream side to endure for the device life or longer; and optimal NIP amount N1 is found for the downstream.

For development device 2 used in the main experiment, it is desirable that at time of the start of the experiment, the least required NIP amount N2 for supply roller 252 on the upstream side to endure for the device life or longer satisfies Expression (3) given below. The experiment proves that the satisfaction of Expression (3) given below enables the least required NIP amount N2 (0.10 mm in the main experiment) for NIP amount N2 to be kept even if development device 2 is used for printing until the life stated in the specification expires.

In Expression (3) given below, "$5\times(10^{-6})$ " represents an amount at which supply roller 252 wears each time the drum count increases by 1 (an amount at which the NIP amount decreases), and may be changed depending on the material used for supply roller 252, the torque and the like. The "$5\times(10^{-6})$" in Expression (3) given below is a value representing the amount at which supply roller 252 wears each time the drum count increases by 1 (the amount at which the NIP amount decreases), and experimentally found using supply roller 252 used in the main experiment. In addition, in Expression (3) given below, "0.10" represents the least required NIP amount N2 to be left after development device 2 is used for the printing until the life stated in the specification expires, and therefore can be set at an arbitrary value depending on the specification of development device 2.

On the basis of Expression (3) given below, the main experiment sets NIP amount N1 at a least required 0.46 mm. It is learned that as shown by Expression (4) given below, N2≥0.46 mm is suitable for development device 2 (whose life is the 72000 drum count) used in the main experiment, when 72000 is substituted for Drum Count in Expression (3). With this taken into consideration, for the purpose of easily finding suitable combinations of NIP amounts N1, N2, the main experiment uses the method in which NIP amount N2 is fixed at 0.46 mm, the value based on Expressions (3), (4) given below; and NIP amount N1 enabling development device 2 to "keep the print quality better until development device 2 reaches the device life stated in the specification" is found by changing NIP amount N1.

$$N2 \geq \text{Life of Development Device (Drum Count)} \times 5 \times (10^{-6}) + 0.10 \text{ [mm]} \quad \text{Expression (3)}$$

$$N2 \geq 72000 \times 5 \times (10^{-6}) + 0.10 = 0.36 + 0.10 = 0.46 \text{ [mm]} \quad \text{Expression (4)}$$

In the experiment with Samples 1, 2, blurs occur in images during the continuous endurance printing. As a result of the evaluation, Samples 1, 2 are rated at Grade "1." The reason for the blurs is that even though supply roller 251 on the downstream side plays the principal role in supplying toner 30, supply roller 251 fails to supply toner 30 onto development roller 23 stably throughout the time period due to the small NIP amount N1.

In the experiment with Samples 3, 4, no problem with the print quality occurs while the continuous endurance printing is performed until the 72000 drum count, the life stated in the specification. As a result of the evaluation, Samples 3, 4 are rated at Grade "3."

In the experiment with Sample 5, no major problem occurs during the continuous endurance printing, but smears sometimes occur in small amounts in the course of the continuous endurance printing. This is because the smears occur due to the toner being excessively electrically charged on the basis of toner stress. The smears are the type of trouble that can be solved by suspending the printing for several hours. As a result of the evaluation, Sample 5 is rated as Grade "2."

In the experiment with Samples 6 to 9, large smears occur. As a result of the evaluation, Samples 6 to 9 are rated at Grade "1." The reason for the large smears is that the NIP amount of supply roller 251 on the downstream side becomes excessively larger over the course of the continuous endurance printing, thus giving excessive load to the toner, accordingly excessively electrically charging the toner. This trouble cannot be solved by suspending the printing for several hours.

On the basis of the results of the experiment above described, it is learned that NIP amount N1 of the supply roller on the downstream side and NIP amount N2 of the supply roller on the upstream are the best in the combinations of Sample 3 (N1 :N2=3:7) and Sample 4 (N1 :N2=4:6). In other words, on the basis of the results of the main experiment, it is learned that it is desirable that NIP amount N1 of the supply roller on the downstream side and NIP amount N2 of the supply roller on the upstream satisfy Expressions (5), (6) given below.

$$N1 + N2 = 100\% \quad \text{Expression (5)}$$

$$N1 : N2 = 3:7 \text{ to } 4:6 \quad \text{Expression (6)}$$

From the results of the experiments illustrated in FIG. 6, it is learned that it is desirable that at least NIP amount N1 of supply roller 251 on the downstream be set at a value smaller than NIP amount N2 of supply roller 252 on the upstream side in order to enable development device 2 to "keep the print quality better until development device 2 reaches the device life stated in the specification." Furthermore, it is learned that it is desirable that the ratio of N1 to N2 be set in a range of 3:7 to 4:6 in order to enable development device 2 to "endure for the device life stated in the specification, and to keep the print quality better." Moreover, from the results of the experiment illustrated in FIG. 6, it is learned that it is desirable that NIP amount N2 of supply roller 252 on the upstream side be set at a value which, as shown by Expression (3) given above, is based on the device life stated in the specification (the drum count) in order to enable development device 2 to endure for the device life stated in the specification.

In addition, for the purpose of confirming the characteristic that the suitable ratio of N1 to N2 is in the range of 3:7 to 4:6, similar experiments are carried out with NIP amount 2 set at 0.50 mm and 0.60 mm. FIG. 7 illustrates results of the experiment which are carried out with NIP amount N2 set at 0.50 mm, and FIG. 8 illustrates results of the experiment which are carried out with NIP amount N2 set at 0.60 mm. Note that neither of the experiments of FIGS. 7 and 8 measures NIP amount N1 for Sample 9 because NIP amount N1 becomes too large (4.00 mm or larger) and accordingly cannot be set from the viewpoint of the device design.

As illustrated in FIGS. 7 and 8, conditions (the ratio of N1 :N2 set in the range of 3:7 to 4:6) in Samples 3, 4 are rated at Grade 3 as a result of evaluating them even though NIP amount N2 is changed, like in the case of the results of the experiment illustrated in FIG. 6. In sum, the experiment illustrated in FIGS. 6 to 8 confirm the characteristic that even though NIP amount N2 is changed, the suitable ratio of N1 to N2 is set in the range of 3:7 to 4:6 in order to enable the development device to "endure for the device life stated in the specification, and to keep the print quality better."

(A-3) Effects of Embodiment

The embodiment can bring about the effects as follows.

In development device 2, NIP amount N1 of supply roller 251 on the downstream side is set at a value smaller than NIP amount N2 of supply roller 252 on the upstream side, and the ratio of N1 :N2 is set in the range of 3:7 to 4:6. This enables development device 2 to "keep the print quality better until development device 2 reaches the device life stated in the specification."

In addition, in development device 2, the least required NIP N2 of supply roller 252 on the upstream side is set at a value based on the device life (the drum count) stated in the specification (for example, the value based on Expression (3)) (set at 0.46 mm in the experiment described above). This enables the development device 2 to suppress problems associated with excessive load on development blade 24 and supply rollers 251, 251 (for example, excessive torque load on the drive sources and excessive wearing of the rollers).

Other Embodiments

The invention is not limited to the foregoing embodiment, and the following modified embodiments also can fall within the scope of the invention.

(B-1)

Although the foregoing embodiment describes the example in which the development device of the invention is applied to development device 2 including not only development roller 23 and supply rollers 251, 252 but also other components, the invention may be applied to (as in the case of the foregoing embodiment, the NIP amounts may be set in) other development devices including at least the development roller and the supply rollers.

(B-2)

Although the foregoing embodiment describes the example where the development device of the invention is applied to the image formation apparatus as the printer, the invention maybe applied to other types of image formation apparatus, such as a duplicator (a copying machine), a multifunction peripheral (MFP), and a facsimile machine.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A development device comprising:

a developer carrier configured to develop an electrostatic latent image with a developer while rotating, the electrostatic latent image being carried on a surface of a rotating electrostatic latent image carrier; and first and second developer supply members configured to, while rotating in the same rotation direction, supply the developer carrier with the developer contained in a developer container, wherein the first developer supply member and the second developer supply member are disposed at positions opposed to the developer carrier, and in contact with the developer carrier, the first developer supply member is disposed downstream of the second developer supply member in a rotational direction of the developer carrier, and a first contact amount at which the first developer supply member is in contact with the developer carrier is set smaller than a second contact amount at which the second developer supply member is in contact with the developer carrier, wherein the first contact amount is not less than 30 percent but not greater than 40 percent of a sum total of the first contact amount and the second contact amount.

2. The development device according to claim 1, wherein the second contact amount is not less than 60 percent but not greater than 70 percent of the sum total of the first contact amount and the second contact amount.

3. The development device according to claim 2, wherein both the first contact amount and the second contact amount are in a range of 0.1 mm to 2.00 mm.

4. The development device according to claim 2, wherein the first contact amount and the second contact amount are in a range of 0.2 mm to 1.00 mm.

5. An image formation apparatus comprising:

an electrostatic latent image carrier configured to carry an electrostatic latent image on its surface while rotating; and the development device according to claim 1, configured to develop the electrostatic latent image on the electrostatic latent image carrier.

6. The development device according to claim 1, wherein each of the first and second developer supply members has axial end portions and an axial middle portions between the axial end portions, wherein the diameters of axial end portions are less than that of the axial middle portion.

7. The development device according to claim 1, wherein each of the first and second developer supply members has axial end portions and an axial middle portion between the axial and portions, wherein the diameters of axial end portions are greater than that of the axial middle portion.

8. The development device according to claim 1, wherein a ratio of a circumferential speed of the first developer supply member to that of the developer carrier is less than a ratio of a circumferential speed of the second developer supply member to that of the developer carrier.

9. The development device according to claim 1, wherein a ratio of a circumferential speed of the first developer supply member to that of the electrostatic latent image carrier is less than a ratio of a circumferential speed of the second developer supply member to that to that of the electrostatic latent carrier.

10. A development device comprising:

a developer carrier configured to develop an electrostatic latent image with a developer while rotating, the electrostatic latent image being carried on a surface of a rotating electrostatic latent image carrier; and first and second developer supply members configured to, while rotating, supply the developer carrier with the developer contained in s developer container, wherein the first developer supply member and the second developer supply member are disposed at positions opposed to the developer carrier, and in contact with the developer carrier, the first developer supply member is disposed downstream of the second developer supply member in a rotational direction of the developer carrier, and a first contact amount at which the first developer supply member is in contact with the developer carrier is set smaller that a second contact amount at which the second developer supply member is in contact with the developer carrier, wherein, letting N2 denote the second contact amount and defining a target life of the development device as continuing until the electrostatic latent image carrier completes M rotations, the second contact amount N2 satisfies the following expression (A):

$$N2 \geq M \times 5 \times (10^{-6}) + 0.1 \text{ [mm]} \quad \text{(A).}$$

11. The development device according to claim 10, wherein the first contact amount is not less than 30 percent but not greater than 40 percent of a sum total of the first contact amount and the second contact amount, and the second contact amount is not less than 60 percent but not greater than 70 percent of the sum total of the first contact amount and the second contact amount.

12. The development device according to claim 11, wherein both the first contact amount and the second contact amount are in a range of 0.1 mm to 2.00 mm.

13. The development device according to claim 11, wherein the first contact amount and the second contact amount are in a range of 0.2 mm to 1.00 mm.

14. An image formation apparatus comprising:

an electrostatic latent image carrier configured to carry an electrostatic latent image on its surface while rotating; and the development according to claim 10, configured to develop the electrostatic latent image on the electrostatic latent image carrier.

* * * * *